United States Patent [19]

Chew

[11] Patent Number: 4,753,403

[45] Date of Patent: Jun. 28, 1988

[54] RAILROAD TRACK MOUNTING ARRANGEMENT

[75] Inventor: James P. Chew, Jeannette, Pa.

[73] Assignee: American Standard Inc., North Hills, Pa.

[21] Appl. No.: 938,934

[22] Filed: Dec. 8, 1986

[51] Int. Cl.[4] ..... E01B 9/32

[52] U.S. Cl. ..... 246/473 R; 238/338

[58] Field of Search ..... 246/473 R; 238/310, 238/338, 343, 361

[56] References Cited

U.S. PATENT DOCUMENTS

| | | | |
|---|---|---|---|
| 1,622,238 | 3/1927 | Myers | 238/338 |
| 1,664,288 | 3/1928 | Durant | 238/338 |
| 2,724,559 | 11/1955 | Dalton | 238/338 |
| 3,066,869 | 12/1962 | Bishop | 238/338 |
| 4,071,191 | 1/1978 | Hutton | 238/338 |

FOREIGN PATENT DOCUMENTS

| | | | |
|---|---|---|---|
| 3443953 | 6/1986 | Fed. Rep. of Germany | 238/310 |

*Primary Examiner*—Joseph F. Peters, Jr.
*Assistant Examiner*—Stephen P. Avila
*Attorney, Agent, or Firm*—J. B. Sotak

[57] ABSTRACT

A railroad track mounting arrangement for mounting a detecting device in proximate relation to a rail head portion of a section of rail includes first and second V-shaped rail clamp member which exhibit inner contours substantially equivalent to the outer contour of the rail base such that a tight fit is achieved therebetween. A side mounting portion extends from the rail clamp members at a point where, upon installation of the rail clamps, the side mounting portions are in close proximity to the rail base. A mounting bracket secures to the side mounting portion and has a base portion for holding in a secure manner the detecting device. A nut and bolt arrangement secures the rail clamps together and, in the event of overtightening, fractures, thereby insuring positive detection of a faulty installation.

12 Claims, 3 Drawing Sheets

RAILROAD TRACK MOUNTING ARRANGEMENT

BACKGROUND OF THE INVENTION

This invention relates to an arrangement for securely mounting monitoring equipment to a section of rail which comprises a portion of a railroad track section. Railroad signalling technology today is such that complex monitoring devices must be secured to as proximate a location to the rail head as possible in order to provide the accurate readings necessary to safely determine certain train characteristics such as, for example, train presence and speed. Such monitoring devices typically utilize electronic components because of the wide range of possible signals that can be derived therefrom. Such electronic components, however, require a solid, or rigid, mounting arrangement; that is, one wherein the shock and vibration of a train passing by does not change the relative position of rail and device, which would adversely affect the output of the monitoring device. Additionally, because the size of the rail can vary on a weight-per-yard basis, there has, to date, been no effort to provide a single rail mounting arrangement that could adapt to differing rail sizes.

Rail mounting arrangements, typically, are designed for a specific device to be mounted to a specific size rail. Consequently, to meet all needs, railroad suppliers, in the past, would have to have at their disposal different types of mounting components.

Furthermore, typical mounting arrangements in the past have attempted to mount the monitoring device and the rail clamp device using one securing arrangement, such as a nut and bolt; that is, to mount the monitoring device to the clamp and the clamp to the rail simultaneously using a single means for securing. Such a procedure is not only overly cumbersome in regard to assembly operations, but also suffers the disadvantage of adding undesirable stress on the single nut, bolt configuration. This is so because the monitoring device, which must reside above and outward of the rail base on a mounting bracket in order to meet the requirement of being at a level with the rail head, is subjected to the vibration and shock introduced when a train passes thereby. The result is that, by mounting the monitoring device/mounting bracket using the same securing arrangement as is used to mount the rail clamp device to the rail base, such shock and vibration which affects the monitoring device is transferred to the rail clamp device. In order to prevent a loosening of the single nut and bolt configuration, the tendency of installation personnel is to overtighten the nut and bolt.

This overtightening tendency has led to a problem more serious than the shock and vibration force the monitoring device, rail clamp device have been experiencing. Since the rail clamp device is essentially V-shaped and fits over the rail base in such a manner that the most extended portion of the rail base fits into the point of the V, such contact puts undesired stress at the weakest point of the V-shaped clamp. In fact, such contact has been found to cause stress cracks at this point and even breakage of the rail clamps. The breakage factor is further compounded by the fact that rail clamping devices to date have not been designed to fit the contour of the rail base but, instead, have been shaped such that the only concern is that the clamp element contacts the top and bottom of the rail base, there being gaps therebetween.

SUMMARY OF THE INVENTION

It is, therefore, an object of the invention to provide a railroad track mounting arrangement for mounting monitoring equipment to a section of rail which comprises a railroad track section which railroad mounting arrangement is independent of the type of rail being used.

It is a further object of the invention to provide such a railroad track mounting arrangement having a separate and distinct securing arrangement used for the monitoring device and bracket as is used for the actual rail clamp.

It is yet a further object of the invention to provide such a railroad track monitoring arrangement whereby stresses occurring during tightening of the rail clamp securing arrangement are reduced such that cracking at the point of the V portion of the rail clamp is prevented.

Still another object of the invention is to provide such a railroad track mounting arrangement which maintains the monitoring device in a precise position and includes an independent mounting bracket which is additionally supported by the rail base.

Yet another claim of the invention is a railroad track mounting arrangement, such that the members that clamp to the rail bases are so proportioned that, upon tightening of the bolt and nut that clamp them to the rail base, the bolt will fail before the yield stress of the rail clamp material is reached at any point in the rail clamp.

Briefly, the invention consists of at least a V-shaped rail clamp portion which has an upper extending portion which contours substantially to the rising upper portion of the rail base. The rail clamp portion also has a lower base portion which fits beneath the rail base and through which extends the opening wherein the securing arrangement of the nut and bolt are mounted. A second similarly shaped rail clamp portion fits over the other side of the rail base to receive the nut and bolt securing means. A side mounting portion extends from the rail clamp portion at approximately the point of the V and in a direction perpendicular to the edge of the rail base such that the monitoring device can be at least partially supported against a portion of the rail base. A center mounting bracket can be separately secured to the side mounting portion of the rail clamp in order to selectively place the monitoring device thereon to achieve proper placement relative to the rail head. A second pair of rail clamp, side mounting portion elements can be secured to the rail base adjacent the aforementioned configuration such that the center mounting bracket can be supported at both ends.

DESCRIPTION AND OPERATION

Figure 1:
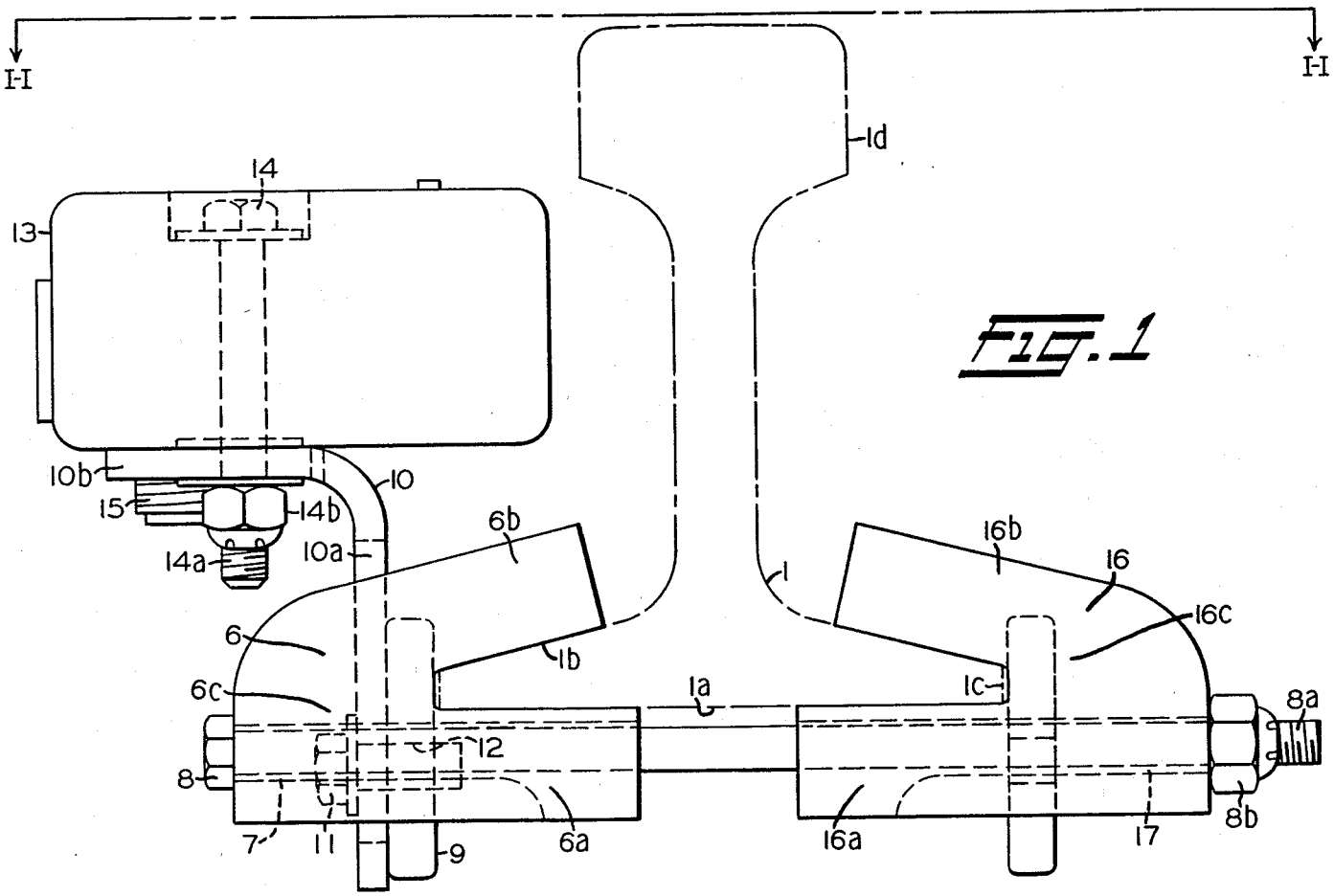
FIG. 1 is an elevational view in section of a railroad track mounting arrangement constructed in accordance with the invention.
Figure 3:
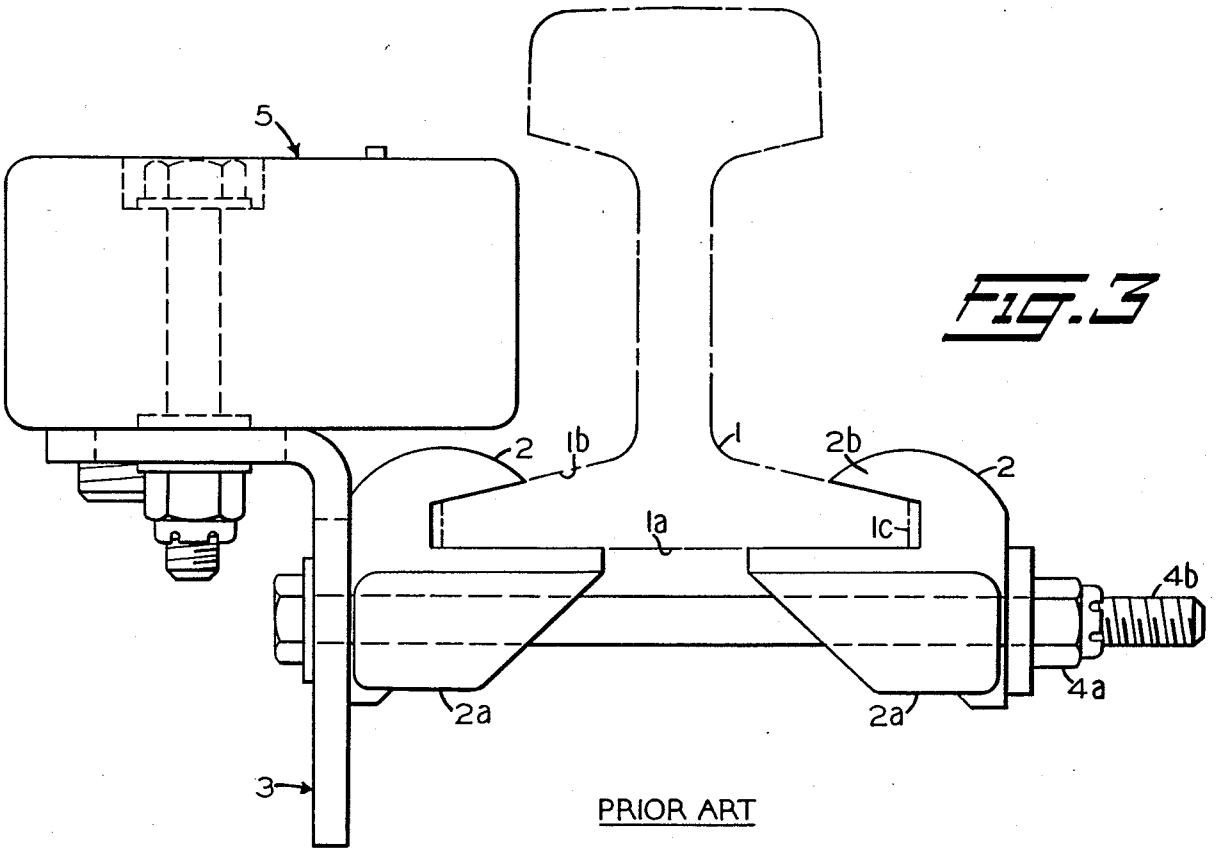
FIG. 3 is an elevational view in section of a railroad track mounting arrangement constructed in accordance with known techniques.

As seen in FIGS. 1 and 3, the railroad track mounting arrangement secures to the rail base portion 1 of a section of rail shown in cross section in the figures. The rail base portion 1 is further illustrated as having a bottom portion 1*a*, an upper sloped portion 1*b*, and a front, facing portion 1*c*. It can be appreciated that the size of the rail base can vary according to a factor known as the rail weight; the rail weight being determined as the weight of the rail per yard length and having values ranging from 90 pounds to 140 pounds.

As shown in FIG. 3, the known technique for mounting monitoring equipment to a section of rail was by use of a clamp 2 having a lower portion 2*a* which is tubular in shape, and an upper, arcuately shaped portion 2*b*. Two similarly shaped of such clamps 2 and a mounting bracket 3 are secured to the rail base 1 by a single nut 4*a* and bolt 4*b* configuration. Because of the single nut and bolt arrangement 4*a*,4*b*, securing the mounting bracket 3 to the clamp 2 is cumbersome and, additionally, results in a less stable base on which the monitoring device 5 is to be mounted. By having the mounting bracket 3 and monitoring device 5 mounted at the end of the clamp 2, the mounting bracket 3 is only indirectly supported by the rail base 1 through the clamp 2 which additionally stresses the clamp 2 and securing arrangement 4*a*,4*b* to the point where overtightening of the securing arrangement 4*a*,4*b* will result in the fracture of the clamp 2 at the point where the upper portion 2*b* connects to the lower portion 2*a*.

As seen in FIG. 1, the railroad track mounting arrangement constructed in accordince with the invention includes a rail clamp member 6 having a lower, bar-shaped portion 6*a* and an upper bar-shaped portion 6*b* extending upward from the lower portion 6*a* at an angle substantially equivalent to the slope of the sloped portion 1*b* of the rail base 1. An extended back portion 6*c* is formed on the rail clamp member 6 at the point where the upper portion 6*b* meets the lower portion 6*a* to achieve increased strength and support at the point of the rail clamp member 6, the extended back portion 6*c* being substantially elbow-shaped. The lower portions 6*b*,6*a* of the rail clamp member thus form an inner contour to the rail clamp member 6 which substantially conforms to the shape of the rail base 1*a* regardless of the rail weight.

Formed longitudinally through the lower portion 6*a* of the rail clamp member 6 is a throughbore 7 into which a securing arrangement 8 is inserted. As illustrated in FIG. 1, the securing arrangement is made up of a bolt 8*a* and lock nut 8*b* configuration. It can be appreciated that, in order to secure the rail clamp member 6 to the rail base 1*b*, some support member or like arrangement must be utilized on the opposite side of the rail base 1*b* on which the rail clamp member 6 is mounted. As shown in FIG. 1, a second rail clamp member 16 is used whereby a second throughbore 17 receives the bolt 8*a* in a manner such that the nut 8*b* can be threaded thereon. It is desirable to use such rail clamp members 6,16 in pairs in order to prevent fracture during installation, which could occur if one weaker-constructed support member were otherwise used.

A mounting support portion 9 is formed on the rail clamp member 6 in a manner transverse and perpendicular to the longitudinal direction of the lower portion 6*a* of the rail clamp member 6. The mounting support portion 9, best illustrated on the right-hand-mounted rail clamp members 16, shown in FIG. 2, extends from the upper and lower portions 16*b*,16*a* of the rail clamp member 16 at essentially the point at which the web portion 16*c* is formed. In this manner, it can be appreciated that the mounting support portion 9 will be proximate to and, in fact, be supported by the front, facing portion 1*c* of the rail base 1 as the rail clamp members 6,16 are secured together.

A mounting bracket 10, shown in FIG. 1, is secured to the rail clamp member 6 at the mounting support portion 9 by means of a cap screw 11 threadedly engaging a threaded opening 12 formed in the mounting support portion 9. A slotted portion 10*a* can be formed in the portion of the mounting bracket 10 through which the cap screw 11 is inserted in such a manner that the height of a base portion 10*b* of the mounting bracket 10 can be adjusted relative to the height of the rail head 1*d*.

The detecting device 13 is secured to the base portion 10*b* of the mounting bracket 10 by means of a second bolt and lock nut arrangement 14*a*,*b*. It can be appreciated that the detecting device 13 can, in fact, be any one of a number of different devices which performs specific desired monitoring functions, such as, for example, the detection of a train wheel, or the wheel speed associated therewith. The most common usage would be the wheel detector type monitoring in which instance the detecting device must be mounted to the inner side of the rail and at a height just below the height of the rail head 1*d*, such positioning being as shown in FIG. 1. A cable connector 15 extends from the bottom of the detecting device 13 so that electrical connections to the detecting device 13 can be made therefrom.

Figure 2:
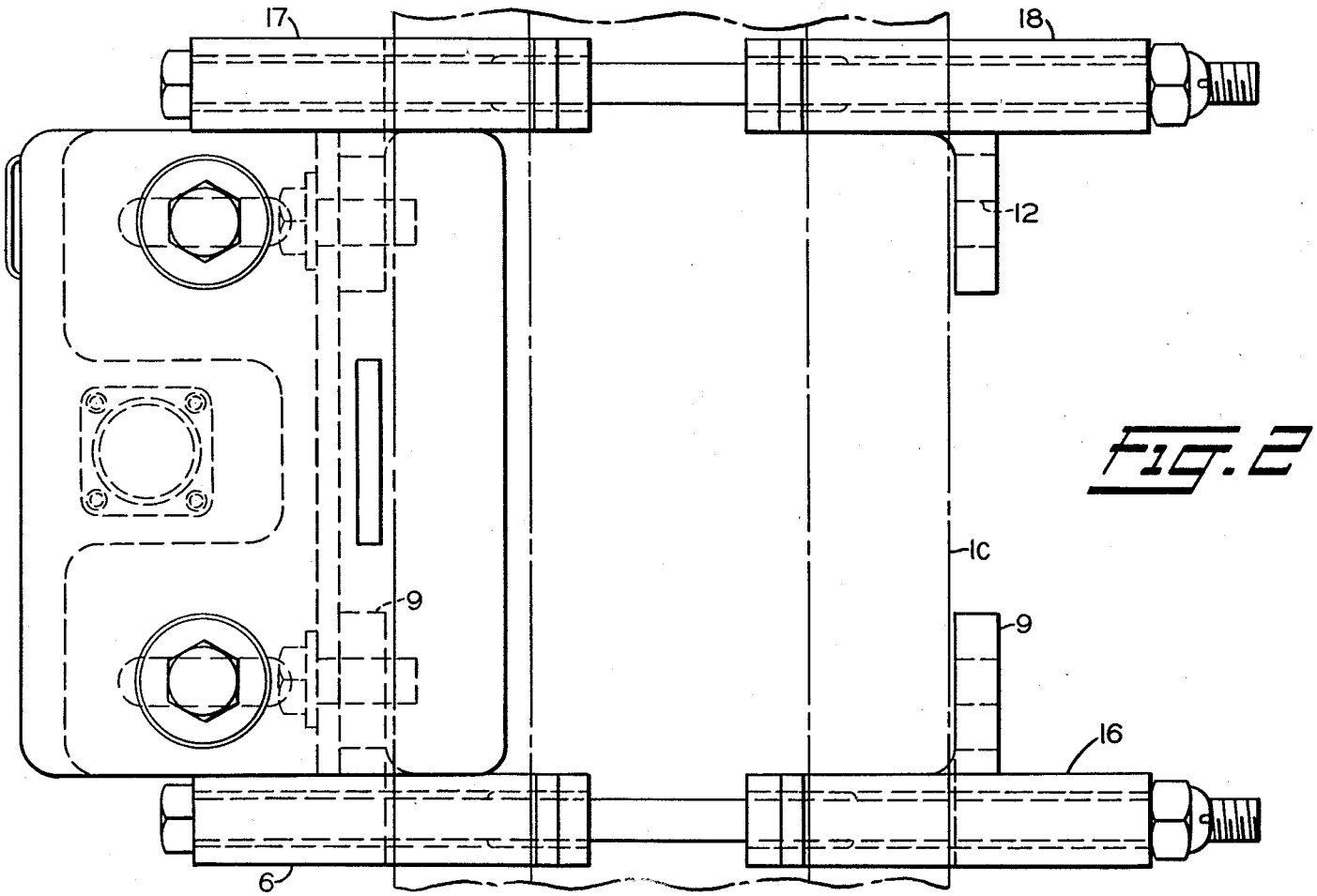
FIG. 2 is an elevational view in section of the railroad track mounting arrangement taken from the direction of arrow I—I shown in FIG. 1.

In order to provide secure mounting of the detecting device 13, a second pair of rail clamp members 17,18 are mounted. As shown in FIG. 2, at a distance on the rail from the first pair of rail clamp member 6,16 essentially corresponding to the width of either the mounting bracket 10 or of the detecting device 13. In this manner, it can be appreciated that the mounting bracket 10, in addition to gaining support from the mounting support portion 9 of the rail clamp member 6 contacting the portions 1*a* and 1*b* of the rail base, gains further suport against transverse movement by being essentially caged within the opposing sides of the two outer disposed rail clamp members 6,17.

In the assembling operation, a first pair of rail clamp members 6,16 is secured to the inner and outer sides of the rail base 1 in a manner such that the respective inner web portions contact the portions 1*a* and 1*b* of the rail base 1. The end positions of the rail clamp members will be dependent on the gage of rail that is being used; in other words, the rail clamp members 6,16 will not be inserted as far onto a rail base of a 140-pound weight rail as can be achieved on the smaller rail weights. The securing arrangement 8, in this instance, a bolt 8*a* and lock nut 8*b* can be tightened the necessary amount without concern for fracturing of either rail clamp member 6 or 16 occurring. The condition of a fracture to the rail clamp member 6 can be especially detrimental where, if not detected upon installation, the more serious results of an actual breakage can occur at a time when the location is unattended, thereby jeopardizing traffic operations in that area. If the bolt 8*a* and lock nut 8*b* arrangement is overtightened, the bolt 8*a* will fracture, not the rail clamp member 6 or 16, and this fracture will visibly manifest itself at installation such that corrective action could be immediately rendered.

The second pair of rail clamp members 17,18 are secured to the rail base 1 in the similar manner as the first pair except that the mounting support portions face in the direction toward the first pair 6,16 so that the mounting bracket 10 can be secured therebetween. The mounting bracket 10 can then be secured to the mounting support portions 9 of the rail clamp members 6,17 disposed on the inner side of the rail. The detecting or monitoring device 13 can then be secured to the base portion 10*b* of the mounting bracket 10. Should it be necessary to adjust the height of the detecting device 13, the cap screws 11 can be temporarily loosened and the mounting bracket 10 can be slid up or down accordingly through the slotted portion 10*a* of the mounting bracket 10. The order of assembly previously detailed need not be strictly adhered to, for instance, the mounting bracket 10 can be secured to the rail clamp members 6,17 before the rail clamp members 6, 16, 17, and 18 are secured to the rail base 1.

Although the hereinabove embodiment of the invention constitutes a preferred form, modifications can be made thereto without departing from the scope of the invention as detailed in the appended claims.

I claim:

1. A railroad track mounting arrangement for securing a monitoring device to a section of rail having a rail head and rail base portion, said mounting arrangement comprising:

(a) a first rail clamp member slidably fitted over one side of the rail base;

(b) a second rail clamp member slidably fitted over an opposite side of the rail base to the side on which said first rail clamp member is slidably fitted;

(c) said first and second rail clamp members including respectively a first and second lower portion which fit against an under portion of the rail base, a first and second upper portion which fit against an upper sloped portion of the rail base, and a first and second rear connecting portion which connect, respectively, said first upper portion to said first lower portion and said second upper portion to said second lower portion of said first and second rail clamp members;

(d) at least one of said first and second rail clamp members being formed such that an inner contour results by such connection of said first and second upper portions to said first and second lower portions, said inner contour conforming substantially in shape to an outer contour of the rail base;

(e) securing means engaging said first and second rail clamp members for securing said first and second rail clamp members to one another across the one and opposite sides of the rail base; and (f) a side mounting portion formed on each of said first and second rail clamp members in a longitudinal axis of said first and second rail clamp members, each of said side mounting portions having a securing opening formed therein such that the monitoring device can be mounted thereon, said side mounting portions extend downward beyond the depth of said first and second lower portions of said first and second rail clamp members and further extend upward beyond the height of the rail base.

2. A railroad track mounting arrangement, as set forth in claim 1, wherein said first and second upper and lower portions of said first and second rail clamps are bar-shaped.

3. A railroad track mounting arrangement, as set forth in claim 1, wherein said inner contour of said at least one of said first and second rail clamp members is shaped to securely contact and be supported by the top and bottom contour of the rail base.

4. A railroad track mounting arrangement, as set forth in claim 1, further comprising a mounting bracket secured to said side mounting portion of said at least one of said first and second rail clamp members, said mounting bracket extending upward from said side mounting portion so as to be positioned substantially equal in height to the rail head.

5. A railroad track mounting arrangement, as set forth in claim 4, wherein said mounting bracket includes a top base portion for securely carrying the monitoring device.

6. A railroad track mounting arrangement, as set forth in claim 5, wherein said mounting bracket includes a slot formed therein, said slot being disposed adjacent said securing opening formed in said side mounting portion and being effective such that said mounting bracket is vertically adjustable thereby.

7. A railroad track mounting arrangement, as set froth in claim 1, wherein said securing means includes a bolt member which extends through first and second throughbores formed respectively in said first and second rail clamp members and a lock nut threadedly engageable with said bolt member, said bolt member being substantially less in material strength than said first and second rail clamp member such that, in the event of an overtightened condition on said securing means, said bolt member will fracture before said first and second rail clamp members.

8. A railroad track mounting arrangement, as set forth in claim 2, wherein said first and second rear connecting portions are elbow-shaped and are substantially wider in thickness than said bar-shaped first and second upper and lower portions of said first and second rail clamp members, said elbow-shaped first and second rear connecting portions being formed so as to present a rounded surface at the outer edge which connects into said first and second upper portions.

9. A railroad track mounting arrangement as set forth in claim 2 wherein said bar-shaped first and second lower portions extend beneath the rail base a length greater than said first and second upper portions extend above the rail base.

10. A railroad track mounting arrangement for securing a monitoring device to a section of rail having a rail head and rail base portion, said mounting arrangement comprising:

(a) a first rail clamp member slidably fitted over one side of the rail base;

(b) a second rail clamp member slidably fitted over an opposite side of the rail base to the side on which said first rail clamp member is slidably fitted;

(c) said first and second rail clamp members including respectively a first and second lower portion which fit against an under portion of the rail base, a first and second upper portion which fit against an upper sloped portion of the rail base, and a first and second rear connecting portion which connect, respectively, said first upper portion to said first lower portion and said second upper portion to said second lower portion of said first and second rail clamp members;

(d) at least one of said first and second rail clamp members being formed such that an inner contour results by such connection of said first and second upper portions to said first and second lower portions, said inner contour conforming substantially in shape to an outer contour of the rail base;

(e) securing means engaging said first and second rail clamp members for securing said first and second rail clamp members to one another across the one and opposite sides of the rail base; and (f) a side mounting portion formed on each of said first and second rail clamp members in a longitudinal axis of said first and second rail clamp members, each of said side mounting portions having a securing opening formed therein such that the monitoring device can be mounted thereon, and third and fourth rail clamp members, said third rail clamp member slidably fitted over one side of the rail base at a predetermined distance along the section of rail relative to said first rail clamp member, said fourth rail clamp member slidably fitted over the opposite side at a predetermined distance along the section of rail relative to said second rail clamp member, said third and fourth rail clamp members being secured together by a second securing means.

11. A railroad track mounting arrangement, as set forth in claim 10, further comprising a second side mounting portion formed on at least one of said third and fourth rail clamp members in a perpendicular, transverse direction to the longitudinal axis of said third and fourth said clamp members, said second side mounting portion being formed so as to extend toward said side mounting portion such that a mounting bracket can be secured on one end to said side mounting portion and on another end to said second side mounting portion.

12. A railroad track mounting arrangement for securing a monitoring device to a section of rail having a rail head and rail base portion, said mounting arrangement comprising:

(a) a first rail clamp member slidably fitted over one side of the rail base;

(b) a second rail clamp member slidably fitted over an opposite side of the rail base to the side on which said first rail clamp member is slidably fitted;

(c) said first and second rail clamp members including respectively a first and second lower portion which fit against an under portion of the rail base, a first and second upper portion which fit against an upper sloped portion of the rail base, and a first and second rear connecting portion which connect, respectively, said first upper portion to said first lower portion and said second upper portion to said second lower portion of said first and second rail clamp members;

(d) at least one of said first and second rail clamp members being formed such that an inner contour results by such connection of said first and second upper portions to said first and second lower portions, said inner contour conforming substantially in shape to an outer contour of the rail base, said inner contour of said at least one of said first and second rail clamp members is shaped to securely contact and be supported by the top and bottom contour of the rail base;

(e) securing means engaging said first and second rail clamp members for securing said first and second rail clamp members to one another across the one and opposite sides of the rail base; and (f) a side mounting portion formed on each one of said first and second rail clamp members in a longitudinal axis of said first and second rail clamp members, each of said side mounting portions having a securing opening formed therein such that the monitoring device can be mounted thereon, said side mounting portions extend from said first and second rail clamp members at a point adjacent said inner contoured portion such that, upon installation of said first and second rail clamp members, said side mounting portions contact the front facing portion of the rail base.

* * * * *